US007858285B2

(12) United States Patent
Sacripante et al.

(10) Patent No.: US 7,858,285 B2
(45) Date of Patent: Dec. 28, 2010

(54) EMULSION AGGREGATION POLYESTER TONERS

(75) Inventors: Guerino G. Sacripante, Oakville (CA); Allan K. Chen, Oakville (CA)

(73) Assignee: Xerox Corporation, Norwalk, CT (US)

( * ) Notice: Subject to any disclaimer, the term of this patent is extended or adjusted under 35 U.S.C. 154(b) by 1056 days.

(21) Appl. No.: 11/556,926

(22) Filed: Nov. 6, 2006

(65) Prior Publication Data

US 2008/0107989 A1 May 8, 2008

(51) Int. Cl.
*G03G 9/08* (2006.01)

(52) U.S. Cl. ..... 430/137.14; 430/137.16

(58) Field of Classification Search ..... 430/137.14, 430/137.16

See application file for complete search history.

(56) References Cited

U.S. PATENT DOCUMENTS 3,847,604 A 11/1974 Hagenbach et al.
4,254,207 A 3/1981 Landoll et al.
4,810,611 A 3/1989 Ziolo et al.
4,935,326 A 6/1990 Creatura et al.
4,937,166 A 6/1990 Creatura et al.
4,952,477 A 8/1990 Fuller et al.
5,057,392 A 10/1991 McCabe et al.
5,147,747 A 9/1992 Wilson et al.
5,166,026 A 11/1992 Fuller et al.
5,278,020 A 1/1994 Grushkin et al.
5,290,654 A 3/1994 Sacripante et al.
5,308,734 A 5/1994 Sacripante et al.
5,344,738 A 9/1994 Kmiecik-Lawrynowicz et al.
5,346,797 A 9/1994 Kmiecik-Lawrynowicz et al.
5,348,832 A 9/1994 Sacripante et al.
5,364,729 A 11/1994 Kmiecik-Lawrynowicz et al.
5,366,841 A 11/1994 Patel et al.
5,370,963 A 12/1994 Patel et al.
5,403,693 A 4/1995 Patel et al.
5,405,728 A 4/1995 Hopper et al.
5,409,557 A 4/1995 Mammino et al.
5,418,108 A 5/1995 Kmiecik-Lawrynowicz et al.
5,428,435 A * 6/1995 Yasuda et al. ..... 430/123.55
5,487,707 A 1/1996 Sharf et al.
5,496,676 A 3/1996 Croucher et al.
5,501,935 A 3/1996 Patel et al.
5,514,436 A 5/1996 Schlueter, Jr. et al.
5,527,658 A 6/1996 Hopper et al.
5,529,876 A * 6/1996 Sasaki et al. ..... 430/137.12
5,536,612 A * 7/1996 Yamaguchi et al. .... 430/137.12
5,567,567 A * 10/1996 Akiyama et al. ..... 430/110.2
5,585,215 A 12/1996 Ong et al.
5,650,255 A 7/1997 Ng et al.
5,650,256 A 7/1997 Veregin et al.
5,672,454 A * 9/1997 Sasaki et al. ..... 430/110.2
5,712,074 A * 1/1998 Sato et al. ..... 430/108.3
5,723,253 A 3/1998 Higashino et al.
5,744,520 A 4/1998 Kmiecik-Lawrynowicz et al.
5,747,215 A 5/1998 Ong et al.
5,750,304 A * 5/1998 Yamaguchi et al. ..... 430/110.1
5,763,130 A * 6/1998 Sasaki et al. ..... 430/110.2
5,763,133 A 6/1998 Ong et al.
5,766,818 A 6/1998 Smith et al.
5,804,349 A 9/1998 Ong et al.
5,827,633 A 10/1998 Ong et al.
5,840,462 A 11/1998 Foucher et al.
5,853,943 A 12/1998 Cheng et al.
5,853,944 A 12/1998 Foucher et al.
5,858,602 A * 1/1999 Yoshimura et al. ..... 430/135
5,869,215 A 2/1999 Ong et al.
5,916,725 A 6/1999 Patel et al.
5,928,830 A 7/1999 Cheng et al.
6,099,673 A 8/2000 Van Bennekom
6,114,473 A 9/2000 Miyake et al.
6,120,967 A 9/2000 Hopper et al.
6,355,391 B1 3/2002 Van Dusen et al.
6,408,753 B1 6/2002 Finn et al.
6,413,691 B2 7/2002 Daimon et al.
6,423,460 B1 7/2002 Drappel et al.
6,764,799 B2 7/2004 Skorokhod et al.
2004/0265721 A1 * 12/2004 Matsuoka et al. ..... 430/109.4

(Continued)

FOREIGN PATENT DOCUMENTS

EP 0 928 995 A2 7/1999

(Continued)

OTHER PUBLICATIONS

Mar. 24, 2010 Office Action issued in U.S. Appl. No. 11/676,059.

(Continued)

*Primary Examiner*—Hoa V Le
(74) *Attorney, Agent, or Firm*—Oliff & Berridge, PLC

(57) ABSTRACT

An emulsion aggregation toner including an amorphous resin and a crystalline resin, wherein the toner has an acid value of from about 16 mg/eq. KOH to about 40 mg/eq. KOH and a relative humidity sensitivity ratio of from about 1 to about 2, and wherein the crystalline resin has a melting point of at least about 60° C. The process for forming particles including generating an emulsion of a polyester resin having an acid value of from about 16 mg/eq. KOH to about 40 mg/eq. KOH and generating aggregate particles from the emulsion. Increased charge maintainability and resistivity of the toner result, thereby generating high print quality and high gloss, and provide stable xerographic charging in all ambient environments.

14 Claims, No Drawings

U.S. PATENT DOCUMENTS

| | | | | |
|---|---|---|---|---|
| 2005/0255398 | A1 | 11/2005 | Hiraoka et al. | |
| 2006/0051693 | A1 | 3/2006 | Sata et al. | |
| 2006/0063086 | A1 | 3/2006 | Sacripante et al. | |
| 2007/0003856 | A1 | 1/2007 | Farrugia et al. | |
| 2008/0090163 | A1 | 4/2008 | Agur et al. | |
| 2009/0117482 | A1 | 5/2009 | Shirai et al. | |
| 2010/0028798 | A1 * | 2/2010 | Yoshida et al. ..... | 430/137.14 |

FOREIGN PATENT DOCUMENTS

| | | | |
|---|---|---|---|
| EP | 1 935 917 | A1 | 6/2008 |
| WO | WO 03/052522 | A1 | 6/2003 |

OTHER PUBLICATIONS

Jul. 12, 2010 Office Action issued in U.S. Appl. No. 11/676,059.

Office Action in Canadian Patent Application No. 2,608,804, mailed Aug. 10, 2010.

Office Action issued Oct. 26, 2010 in U.S. Appl. No. 11/676,059.

* cited by examiner

EMULSION AGGREGATION POLYESTER TONERS

BACKGROUND

The present disclosure generally relates to toners and developers containing the toners, and their use in methods for forming and developing images of good quality and gloss, and in particular to emulsion aggregation toners containing a polyester resin.

The toners herein are advantageous in desired print quality and high gloss, and provide stable xerographic charging in all ambient environments.

REFERENCES

Emulsion aggregation toners are excellent toners to use in forming print and/or xerographic images in that the toners can be made to have uniform sizes and in that the toners are environmentally friendly. U.S. patents describing emulsion aggregation toners include, for example, U.S. Pat. Nos. 5,370,963, 5,418,108, 5,290,654, 2,278,020, 5,308,734, 5,344,738, 5,403,693, 5,364,729, 5,346,797, 5,348,832, 5,405,728, 5,366,841, 5,496,676, 5,527,658, 5,585,215, 5,650,255, 5,650,256, 5,501,935, 5,723,253, 5,744,520, 5,763,133, 5,766,818, 5,747,215, 5,827,633, 5,853,944, 5,804,349, 5,840,462, and 5,869,215, the entire disclosures of which are incorporated herein by reference.

Two main types of emulsion aggregation (or EA) toners are known. One type of emulsion aggregation process that forms acrylate based, for example, styrene acrylate, based particles. See, for example, U.S. Pat. No. 6,120,967, incorporated herein by reference in its entirety, as one example of such an EA toner. Another type of emulsion aggregation process forms polyester, e.g., sulfonated polyester, based particles. See, for example, U.S. Pat. No. 5,916,725, incorporated herein by reference in its entirety, as one example of such an EA toner.

Emulsion aggregation techniques typically involve the formation of an emulsion latex of the resin particles, which particles have a small size of from, for example, about 5 to about 500 nanometers in diameter, by heating the resin, optionally with solvent if needed, in water, or by making a latex in water using emulsion polymerization. A colorant dispersion, for example of a pigment dispersed in water, optionally also with additional resin, is separately formed. The colorant dispersion is added to the emulsion latex mixture, and an aggregating agent or complexing agent is then typically added to initiate aggregation of larger size toner particles. Once desired size toner particles are achieved, aggregation is stopped. The aggregated toner particles may then be heated to enable coalescence/fusing, thereby achieving aggregated, fused toner particles.

Low fixing toners comprised of semicrystalline resins are known, such as those disclosed in U.S. Pat. No. 5,166,026. There, toners comprised of a semicrystalline copolymer resin, such as poly(alpha-olefin) copolymer resins, with a melting point of from about 30° C. to about 100° C., and containing functional groups comprising hydroxy, carboxy, amino, amido, ammonium or halo, and pigment particles, are disclosed. Similarly, in U.S. Pat. No. 4,952,477, toner compositions comprised of resin particles selected from the group consisting of a semicrystalline polyolefin and copolymers thereof with a melting point of from about 50° C. to about 100° C. and pigment particles are disclosed.

Low fixing crystalline based toners are disclosed in U.S. Pat. No. 6,413,691. There, a toner comprised of a binder resin and a colorant, the binder resin containing a crystalline polyester containing a carboxylic acid of two or more valences having a sulfonic acid group as a monomer component, are illustrated.

Crystalline based toners are disclosed in U.S. Pat. No. 4,254,207. Low fixing toners comprised of crosslinked crystalline resin and amorphous polyester resin are illustrated in U.S. Pat. Nos. 5,147,747 and 5,057,392. In each, the toner powder is comprised, for example, of polymer particles of partially carboxylated crystalline polyester and partially carboxylated amorphous polyester that has been crosslinked together at an elevated temperature with the acid of an epoxy novolac resin and a crosslinking catalyst.

Polyester based emulsion aggregation toners may exhibit a decrease in charge maintainability and toner resistivity of the toner, for example, A-zone charging and development may be decreased due to the RH sensitivity of the polyester resin and use of ions, such as metals, in the aggregation step. Further, drastic changes in pH during the process of making the toner may promote polyester resin hydrolysis in water, and thus may create unwanted oligomers and ionic by products, especially at elevated temperatures. Additionally, the use of too much surfactant may also create such problems unless they are removed. There is thus a need for a toner that minimizes or avoids use of metal ions as coagulants and excessive surfactants, and a more neutral pH process range to improve the performance of the toners, particularly in the A-zone.

What is still desired is a polyester resin emulsion aggregation toner that can achieve excellent print quality, high gloss, and stable xerographic charging in all ambient environments for all colors, while minimizing or eliminating the use of ions and surfactants in the process of making the toners to be minimized.

SUMMARY

These and other improvements are accomplished by the toners described herein.

In embodiments, the toner is an emulsion aggregation polyester toner comprising an amorphous resin and a crystalline resin, where the toner has an acid value of from about 16 mg/eq. KOH to about 40 mg/eq. KOH, wherein the toner has a melting point of from about 50° C. to about 130° C.

In embodiments, described is a process for forming particles, comprising generating an emulsion of a polyester resin having an acid value of from about 16 mg/eq. KOH to about 40 mg/eq. KOH, and subjecting the emulsion to aggregation to form aggregated toner particles.

EMBODIMENTS

Toners useful for xerographic applications should possess certain properties related to storage stability and particle size integrity. That is, it is desired to have the particles remain intact and not agglomerate until they are fused on paper. Since environmental conditions vary, the toners also should not substantially agglomerate up to a temperature of from about 50° C. to about 55° C.

The toner, comprised of at least resin and colorant, should also display acceptable triboelectrification properties which vary with the type of carrier or developer composition.

The toner should also possess low melting properties. That is, the toner may be a low melt or ultra low melt toner. Low melt toners display a melting point from about 80° C. to about 130° C., such as from about 90° C. to about 120° C., while ultra low melt toners display a melting point of from about 50° C. to about 100° C., such as from about 50° C. to about 90° C. Thus, the EA polyester toners disclosed herein display a melting point of from about 50° C. to 130° C. or from about 50° C. to about 120° C.

Additionally, small sized toner particles, such as from about 3 to about 15 microns, and for example from about 5 to about 12 microns, are desired, especially in xerographic engines wherein high resolution is required. Toners with the aforementioned small sizes can be economically prepared by chemical processes, also known as direct or "in situ" toner process, such as the emulsion aggregation process, or by suspension, microsuspension or microencapsulation processes.

Disclosed herein are emulsion aggregation toners, and processes for making emulsion aggregation toners, that exhibit one or more of the above desirable properties. The EA polyester toners are derived from at least one high acid polyester resin. That is, the starting polyester resin in the emulsion used to form aggregated toner particles has a high acid value. As a result, the EA polyester toner also has the high acid value. "High acid value" as used herein refers to, for example, an acid value of from about 16 mg/eq. KOH to about 40 mg/eq. KOH, for example, from about 20 mg/eq. KOH to about 35 mg/eq. KOH, or such as from about 20 mg/eq. KOH to about 25 mg/eq. KOH. The acid value is determined by titration method using potassium hydroxide as a neutralizing agent with a pH indicator.

As a result of such acid number value of the polyester in the initial emulsion, the use of surfactants in forming particles in the emulsion aggregation process may be omitted. This may be desirable where surfactants contribute to an end toner having reduced relative humidity (or RH) stability, particularly in the A-zone environment.

It is desirable that toners and developers be functional under a broad range of environmental conditions to enable good image quality from a printer. Thus, it is desirable for toners and developers to function well in each of low humidity and low temperature, for example at 10° C. and 15% relative humidity (denoted herein as C-zone), moderate humidity and temperature, for example at 21° C. and 40% relative humidity (denoted herein as B-zone), and high humidity and temperature, for example at 28° C. and 85% relative humidity (denoted herein as A-zone).

For good performance under a broad range of conditions, properties of the toner should change as little as possible across the above environmental zones described as A-zone, B-zone and C-zone. A valuable toner attribute is thus the relative humidity sensitivity ratio, that is, the ability of a toner to exhibit similar charging behavior at different environmental conditions such as high humidity or low humidity. If there is a large difference across these zones, the materials may have a large relative humidity (RH) sensitivity ratio, which means that the toner may show performance shortfalls in the extreme zones, either at low temperature and humidity, or high temperature and humidity, or both. In embodiments, a RH sensitivity ratio may be expressed as a ratio of a triboelectric charge of the toner developer in the C-zone to a triboelectric charge of the toner developer in A-zone. A goal is for the RH sensitivity ratio to be as close to one as possible. When such an RH sensitivity ratio is achieved, the toner may be equally effective in both high humidity and low humidity conditions. Stated another way, the toner has low sensitivity to changes in RH. In embodiments, the RH sensitivity ratio may be in the range from about 1 to about 2, for example from about 1.1 to about 1.7 or from about 1.1 to about 1.5.

The polyester resin with a high acid number at a minimum permits the use of less surfactant in the emulsion compared to prior polyester resin emulsions with lower acid numbers, and thus promotes RH stability of the formed polyester particles, particularly in the A-zone. Typically, in conventional EA processes, the surfactant may be present in the toner in an amount from about 2 to about 3 percent by weight of the toner. The toner of the present application may contain surfactant in a range from about 0 to about 1 percent by weight of the toner. Desirably, the use of the high acid number polyester permits the use of surfactants to be eliminated.

The polyester resin with a high acid number thus allows for a toner that is substantially free of surfactant and/or coagulant. It is desirable for the toner that contains little or no surfactant so that washing of the toner can be minimized and removal of surfactants from water during recycling is easier. A toner with no coagulant is desirable for good A-zone charge.

The polyester resin may be synthesized to have high acid numbers, for example high carboxylic acid numbers. The polyester resin is made to have a high acid number by using an excess amount of diacid monomer over the diol monomer, or by using acid anhydrides to convert the hydroxl ends to acid ends, for example by reaction of the polyester with known organic anhydrides.

In embodiments, the polyester may be, for example poly (1,2-propylene-diethylene)terephthalate, polyethylene-terephthalate, polypropylene-terephthalate, polybutylene-terephthalate, polypentylene-terephthalate, polyhexalene-terephthalate, polyheptadene-terephthalate, polyoctalene-terephthalate, polyethylene-sebacate, polypropylene-sebacate, polybutylene-sebacate, polyethylene-adipate, polypropylene-adipate, polybutylene-adipate, polypentylene-adipate, polyhexalene-adipate polyheptadene-adipate, polyoctalene-adipate, polyethylene-glutarate, polypropylene-glutarate, polybutylene-glutarate, polypentylene-glutarate, polyhexalene-glutarate, polyheptadene-glutarate, polyoctalene-glutarate, polyethylene-pimelate, polypropylene-pimelate, polybutylene-pimelate, polypentylene-pimelate, polyhexalene-pimelate, polyheptadene-pimelate, poly (propoxylated bisphenol co-fumarate), poly(ethoxylated bisphenol co-fumarate), poly(butyloxylated bisphenol co-fumarate, poly(co-propoxylated bisphenol co ethoxylated bisphenol co-fumarate), poly(1,2-propylene fumarate), poly (propoxylated bisphenol co-maleate), poly(ethoxylated bisphenol co-maleate), poly(butyloxylated bisphenol co-maleate), poly(co-propoxylated bisphenol co ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co ethoxylated bisphenol co-itaconate), or poly(1,2-propylene itaconate).

In embodiments, the polyester resin and resulting EA polyester toner each has a high acid number, in one embodiment, for example, from about 16 mg/eq. KOH to about 40 mg/eq. KOH, in another embodiment from about 20 mg/eq. KOH to about 35 mg/eq. KOH and in yet another embodiment from about 20 mg/eq. KOH to about 25 mg/eq. KOH.

In embodiments, the resin is an amorphous, crystalline, semi-crystalline, or mixture thereof, polyester.

Examples of amorphous resins suitable for use herein include polyester resins, branched and linear polyester resins.

The amorphous resin is a branched amorphous polyester resin or a linear amorphous polyester resin. Branched amorphous polyester resins are used, for example, when the fuser does not contain a fuser oil or when black or matte prints are desired.

The branched amorphous polyester resins are generally prepared by the polycondensation of an organic diol, a diacid or diester, and a multivalent polyacid or polyol as the branching agent and a polycondensation catalyst.

Liner amorphous polyester resins are used, for example, when the fuser includes an oil.

Examples of diacid or diesters selected for the preparation of amorphous polyesters include dicarboxylic acids or diesters selected from the group consisting of terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and mixtures thereof. The organic diacid or diester are selected, for example, from about 45 to about 52 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hyroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl) oxide, dipropylene glycol, dibutylene, and mixtures thereof. The amount of organic diol selected can vary, and more specifically, is, for example, from about 45 to about 52 mole percent of the resin.

Branching agents to generate a branched amorphous polyester resin include, for example, a multivalent polyacid such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane, and 1,2,7,8-octanetetracarboxylic acid, acid anhydrides thereof, and lower alkyl esters thereof, 1 to about 6 carbon atoms; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. The branching agent amount selected is, for example, from about 0.1 to about 5 mole percent of the resin.

The amorphous resin may be, for example, present in an amount from about 50 to about 90 percent by weight, and, for example, from about 65 to about 85 percent by weight of the toner. The amorphous resin may be a branched or linear amorphous polyester resin. The amorphous resin may possess, for example, a number average molecular weight (Mn), as measured by gel permeation chromatography (GPC), of from about 10,000 to about 500,000, and for example from about 5,000 to about 250,000; a weight average molecular weight (Mw) of, for example, from about 20,000 to about 600,000, and for example from about 7,000 to about 300,000, as determined by GPC using polystyrene standards; and wherein the molecular weight distribution (Mw/Mn) is, for example, from about 1.5 to about 6, and more specifically, from about 2 to about 4.

The crystalline resin may be, for example, a polyester. In embodiments, the crystalline resins are polyester resins.

Examples of a crystalline polyester resins that are suitable for use herein are poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly (pentylene-sebacate), poly(hexylene-sebacate), poly(octylene-sebacate), copoly(5-sulfoisophthaloyl)-copoly(ethylene-adipate), copoly(5-sulfoisophthaloyl)-copoly (propylene-adipate), copoly(5-sulfoisophthaloyl)-copoly (butylene-adipate), copoly(5-sulfo-isophthaloyl)-copoly (pentylene-adipate), copoly(5-sulfo-isophthaloyl)-copoly (hexylene-adipate), copoly(5-sulfo-isophthaloyl)-copoly (octylene-adipate), copoly(5-sulfo-isophthaloyl)-copoly (ethylene-adipate), copoly(5-sulfo-isophthaloyl)-copoly (propylene-adipate), copoly(5-sulfo-isophthaloyl)-copoly (butylene-adipate), copoly(5-sulfo-isophthaloyl)-copoly (pentylene-adipate), copoly(5-sulfo-isophthaloyl)-copoly (hexylene-adipate), copoly(5-sulfo-isophthaloyl)-copoly (octylene-adipate), copoly(5-sulfoisophthaloyl)-copoly (ethylene-succinate), copoly(5-sulfoisophthaloyl)-copoly (propylene-succinate), copoly(5-sulfoisophthaloyl)-copoly (butylene-succinate), copoly(5-sulfoisophthaloyl)-copoly (pentylene-succinate), copoly(5-sulfoisophthaloyl)-copoly (hexylene-succinate), copoly(5-sulfoisophthaloyl)-copoly (octylene-succinate), copoly(5-sulfo-isophthaloyl)-copoly (ethylene-sebacate), copoly(5-sulfo-isophthaloyl)-copoly (propylene-sebacate), copoly(5-sulfo-isophthaloyl)-copoly (butylene-sebacate), copoly(5-sulfo-isophthaloyl)-copoly (pentylene-sebacate), copoly(5-sulfo-isophthaloyl)-copoly (hexylene-sebacate), copoly(5-sulfo-isophthaloyl)-copoly (octylene-sebacate), copoly(5-sulfo-isophthaloyl)-copoly (ethylene-adipate), copoly(5-sulfo-isophthaloyl)-copoly (propylene-adipate), copoly(5-sulfo-isophthaloyl)-copoly (butylene-adipate), copoly(5-sulfo-isophthaloyl)-copoly (pentylene-adipate), copoly(5-sulfo-isophthaloyl)-copoly (hexylene-adipate), or polyoctylene-adipate).

The crystalline resin may be derived from monomers selected from sebacic acid, dodecanedioic acid, ethylene glycol and butylene glycol. One skilled in the art will easily recognize the monomer can be any suitable monomer to generate the crystalline resin. For example, sebacic acid can be replaced by fumaric acid or adipic acid.

The crystalline resin may be, for example, present in an amount of from about 5 to about 50 percent by weight of the toner, and such as from about 5 to about 30 percent by weight of the binder.

The crystalline resin can possess melting points of, for example, from at least about 60° C., and such as from about 70° C. to about 80° C., and a number average molecular weight (Mn), as measured by gel permeation chromatography (GPC) of, for example, from about 1,000 to about 50,000, and such as from about 2,000 to about 25,000; with a weight average molecular weight (Mw) of the resin of, for example, from about 2,000 to about 100,000, and such as from about 3,000 to about 80,000, as determined by GPC using polystyrene standards. The molecular weight distribution (Mw/Mn) of the crystalline resin is, for example, from about 2 to about 6, and more specifically, from about 2 to about 4.

The crystalline resin may be prepared by a polycondensation process of reacting an organic diol and an organic diacid in the presence of a polycondensation catalyst. Generally, a stoichiometric equimolar ratio of organic diol and organic diacid is utilized. However, in some instances, wherein the boiling point of the organic diol is from about 180° C. to about 230° C., an excess amount of diol can be utilized and removed during the polycondensation process. Additional amounts of acid may be used to obtain the high acid number of the resin, for example, an excess of diacid monomer or anhydride may be used.

The amount of catalyst utilized varies, and can be selected in an amount, for example, of from about 0.01 to about 1 mole percent of the resin. Additionally, in place of an organic diacid, an organic diester can also be selected, and where an alcohol byproduct is generated.

Examples of organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, mixtures thereof, and the like. The aliphatic diol is, for example, selected in an amount of from about 45 to about 50 mole percent of the resin, and the alkali sulfo-aliphatic diol can be selected in an amount of from about 1 to about 10 mole percent of the resin.

Examples of organic diacids or diesters selected for the preparation of the crystalline resins include oxalic acid, succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof.

Polycondensation catalyst examples for either the crystalline or amorphous polyesters include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or mixtures thereof; and which catalysts are selected in amounts of, for example, from about 0.01 mole percent to about 5 mole percent based on the starting diacid or diester used to generate the polyester resin.

In embodiments, the process of making particles from the high acid number polyester involves first generating an emulsion of the high acid number polyester. The emulsion of polyester resin may be generated by dispersing the resin in an aqueous medium by any suitable means. As one example, the emulsion may be formed by dissolving the high acid number polyester resin in an organic solvent, neutralizing the acid groups with an alkali base, dispersing with a mixer in water followed by heating to remove the organic solvent, thereby resulting in a latex emulsion. Desirably, the emulsion includes seed particulates of the polyester having an average size of, for example, from about 10 to about 500 nm, such as from about 10 nm to about 400 nm or from about 250 nm to about 250 nm.

In embodiments, the polyester resin may thus be dissolved in the organic solvent and neutralized with an alkali base, heated to 60° C. and homogenized at 2000 rpm to 4000 rpm for 30 minutes, followed by distillation to remove the organic solvent.

Any suitable organic solvent may be used to dissolve the polyester resin, for example, including alcohols, esters, ethers, ketones and amines, such as ethyl acetate in an amount of, for example, about 1% to about 25%, such as about 10% resin to solvent weight ratio.

The acid groups of the polyester resin may be neutralized with an alkali base. Suitable alkali bases include, for example, sodium hydroxide, potassium hydroxide, lithium hydroxide, ammonium hydroxide, sodium bicarbonate, sodium carbonate, lithium carbonate, lithium bicarbonate, potassium bicarbonate and potassium carbonate. The alkali base is used in an amount to fully neutralize the acid. Complete neutralization is accomplished by measuring the pH of the emulsion, for example, pH of about 7.

In embodiments, the at least one high acid number polyester resin can thus be emulsified in water without surfactant, for example by utilizing an alkali base such as sodium hydroxide. The carboxylic acid groups of the polyester are ionized to the sodium (or other metal ion) salt and self stabilize when prepared by a solvent flash process.

The use of a polyester resin synthesized with high acid numbers, for example synthesized with a high carboxylic acid number, thus creates enough ionic stabilization from the resin that nanometer size resin emulsions can be prepared by base neutralization, for example from about pH 6.5 to 7.5, such as about 6.5 to 7, with high shear homogenization without the need for surfactants for stabilization.

In embodiments, the process includes adding to the emulsion a colorant dispersion, for example of about 4% to about 10% by weight of toner, and optionally a wax dispersion, for example from about 6% to about 9% by weight of toner, and shearing with a homogenizer.

Once the emulsion is formed, aggregation may commence. It is optimal to avoid or minimize the use of coagulants for aggregation. Coagulants can introduce metal ions to the toner that cause a decrease in charge maintainability and toner resistivity of the toner. Thus, the aggregation may be conducted by adjusting the pH of the mixture, although the use of coagulants is not excluded herein.

In embodiments, pH adjustment is accomplished by adding an aqueous solution of acid. Suitable aqueous solution of acid include any acid with a pH less than about 5.5, such as sulfuric acid, phosphoric acid, citric acid, nitric acid or an organic soluble acid, in an amount of for example from about 0.01 to 1 molar with homogenization at 4000 to 6000 rpm, until the pH of the mixture is, for example, from about 3 to about 4. Thus, an initial aggregate of the size for example from about 1 to about 3 microns is generated by the pH adjustment.

In embodiments, the process further involves raising the temperature to about 40° C. to 50° C. to allow for particle growth to about 5 to about 7 microns, followed by raising the pH for example to a range of about 6.3 to about 9, with a base such as sodium hydroxide, to prevent further growth, and heating the mixture, for example to about 60° C. to about 95° C., for coalescence of the aggregate and then optionally decreasing the pH, for example to a range of from about 6 to about 6.8, to further enable coalescence of the particles.

For example, polyester ultra low melt emulsion aggregation toner particles can be prepared from emulsions with or without the use of alkali metal coagulants and with or without the use of surfactants within a pH range of from about 3 to about 8, and such as from about 4 to about 7. Drastic pH changes during the process, especially, for example, from pHs less than about 3 and/or higher than about 8, may promote polyester resin hydrolysis in water, creating unwanted oligomers and ionic byproducts.

In embodiments, the process for making the toner without surfactants and/or coagulants thus involves forming a latex by generating an emulsion of a polyester resin having an acid value of from about 16 mg/eq. KOH to about 40 mg/eq. KOH, dissolving the polyester resin in an organic solvent, neutralizing the acid groups with an alkali base, dispersing in water followed by heating to remove the organic solvent, and optionally adding to the emulsion a colorant dispersion and/or a wax dispersion, shearing and adding an aqueous solution of acid until the pH of the mixture is from about 3 to about 5.5, heating to a temperature of from about 30° C. to 60° C., wherein the aggregate grows to a size of from about 3 to about 20 microns, raising the pH of the mixture to a range of about 7 to about 9, heating the mixture to about 60° C. to about 95° C., and optionally decreasing the pH to a range of 6.0 to 6.8. Raising the pH to about 7 to about 9 halts further growth of the particles.

It is optimal to avoid or minimize the use of surfactants and coagulants that decrease toner resistivity and charge maintainability. The addition of a surfactant and/or coagulant is thus optional.

In embodiments, the process involves optionally adding a surfactant to the emulsion in an amount of, for example, about 0.5 percent to about 5 percent, such as about 1 percent by weight of the toner, heating to temperature of from about 30° C. to 60° C. and wherein the aggregate composite grows to a size of from about 3 to about 20 microns, such as from about 3 to about 11 microns.

Suitable surfactants may include anionic, cationic and nonionic surfactants.

Anionic surfactants can include, for example, sodium dodecylsulfate (SDS), sodium dodecylbenzene sulfonate, sodium dodecylnapthalane sulfate, dialkyl benzenealkyl, sulfates and sulfonates, adipic acid, available from Aldrich, NEOGEN RK™, NEOGEN SC™ from Kao, and the like.

Examples of cationic surfactants can include dialkyl benzene alkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecyl benzyl triethyl ammonium chloride, MIRAPOL and ALKAQUAT available from Alkaril Chemical Company, SANISOL (benzalkonium chloride), available from Kao Chemicals, and the like. An example of a preferred cationic surfactant is SANISOL B-50 available from Kao Corp., which comprises primarily benzyl dimethyl alkonium chloride.

Examples of nonionic surfactants may include, for example, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhodia as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™.

Examples of additional surfactants, which may be added optionally to the aggregate suspension prior to or during the coalescence to, for example, prevent the aggregates from growing in size, or for stabilizing the aggregate size, with increasing temperature can be selected from anionic surfactants such as sodium dodecylbenzene sulfonate, sodium dodecylnaphthalene sulfate, dialkyl benzenealkyl, sulfates and sulfonates, adipic acid, available from Aldrich, NEOGEN R™, NEOGEN SC™ available from Daiichi Kogyo Seiyaku, and the like, among others.

In embodiments, the process may use a coagulant in an amount from about 0.1 to about 2 percent by weight of the toner, such as 0.1 to 1 percent by weight of the toner.

When using a coagulant, the process for making the toner involves generating an emulsion of polyester resin by dissolving the resin in an organic solvent, neutralizing the acid groups with an alkali base, dispersing with a mixer in water followed by heating to remove the organic solvent, thereby resulting in a latex, adding thereto a pigment dispersion for example from about 4% to about 25% by weight of toner, optionally a wax dispersion for example from about 5% to about 25% by weight of toner, and optionally a surfactant for example from about 0.1% to about 3% by weight of toner, and shearing with a homogenizer and adding an aqueous solution of acid, such as nitric acid, from about 0.01 to about 1 molar, until the pH of the mixture is, for example, from about 2.5 to about 4, followed by adding an aqueous solution of coagulant during homogenization and thereby generating an initial aggregate composite with a size for example of from about 1 to about 3 microns, heating to a temperature of from about 30° C. to about 60° C. and wherein the aggregate composite grows to a size for example of from about 3 to about 20 microns, such a from about 3 to about 11 microns, raising the pH of the mixture to a range of for example from about 6.5 to about 9 and heating the mixture to for example from about 60° C. to about 95° C. and optionally decreasing the pH to a range of for example from about 6.0 to about 6.8.

In embodiments, the coagulant may be an inorganic coagulant. Inorganic cationic coagulants include, for example, poly-aluminum chloride (PAC), poly-aluminum sulfosilicate (PASS), aluminum sulfate, zinc sulfate, magnesium sulfate, chlorides of magnesium, calcium, zinc, beryllium, aluminum, sodium, other metal halides including monovalant and divalent halides. The coagulant may be present in an emulsion in an amount of from, for example, from about 0 to about 10 percent by weight, or from about 0.05 to about 5 percent by weight of total solids in the toner. The coagulant may also contain minor amounts of other components, for example nitric acid.

In embodiments, polyaluminum chloride (PAC) is used as a coagulant. A sequestering agent may optionally be introduced to sequester or extract a metal complexing ion such as aluminum from the coagulant during the EA process.

The final metal ion content in the toner may be in the range of about 250 to about 500 ppm, more specifically from about 300 to about 400 ppm or from about 350 to about 450 ppm.

In embodiments, a sequestering agent may be introduced after aggregation is complete to sequester or extract a metal complexing ion such as aluminum from the coagulant during the EA process.

In embodiments, the sequestering or complexing component used after aggregation is complete may comprise an organic complexing component selected from the group consisting of ethylenediaminetetraacetic acid (EDTA), gluconal, sodium gluconate, potassium citrate, sodium citrate, nitrotriacetate salt, humic acid, and fulvic acid; salts of ethylenediaminetetraacetic acid, gluconal, sodium gluconate, potassium citrate, sodium citrate, nitrotriacetate salt, humic acid, and fulvic acid, alkali metal salts of ethylenediaminetetraacetic acid, gluconal, sodium gluconate, potassium citrate, sodium citrate, nitrotriacetate salt, humic acid, and fulvic acid; sodium salts of ethylenediaminetetraacetic acid, gluconal, sodium gluconate, tartaric acid, gluconic acid, oxalic acid, polyacrylates, sugar acrylates, citric acid, potassium citrate, sodium citrate, nitrotriacetate salt, humic acid, and fulvic acid; potassium salts of ethylenediaminetetraacetic acid, gluconal, sodium gluconate, potassium citrate, sodium citrate, nitrotriacetate salt, humic acid, and fulvic acid; and calcium salts of ethylenediaminetetraacetic acid, gluconal, sodium gluconate, potassium citrate, sodium citrate, nitrotriacetate salt, humic acid, fulvic acid, calcium disodium ethylenediaminetetraacetate dehydrate, diammoniummethylenediaminetetraacetic acid, pentasodium diethylenetriaminepentaacetic acid sodium salt, trisodium N-(hydroxyethyl)-ethylenediaminetriacetate, polyasparic acid, diethylenetriamine pentaacetate, 3-hydroxy-4-pyridinone, dopamine, eucalyptus, iminodisuccinic acid, ethylenediaminedisuccinate, polysaccharide, sodium ethylenedinitrilotetraacetate, nitrilo triacetic acid sodium slat, thiamine pyrophosphate, farnesyl pyrophosphate, 2-aminoethylpyrophosphate, hydroxyl ethylidene-1,1-diphosphonic acid, aminotrimethylenephosphonic acid, diethylene triaminepentamethylene phosphonic acid, ethylenediamine tetramethylene phosphonic acid, and mixtures thereof.

Toner particles may contain a colorant. Any desired or effective colorant can be employed, including pigment, dye, mixtures of pigment and dye, mixtures of pigments, mixtures of dyes, dan the like, may be included in the toner.

Examples of suitable colorants for making toners include carbon black such as REGAL 330®, magnetites, such as Mobay magnetites MO8029™, MO8060™; Columbian magnetites; MAPICO BLACKS™ and surface treated magnetites; Pfizer magnetites (CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected, for example, various known cyan, magenta, yellow, red, green, brown, blue colorants or mixtures thereof. Specific examples of pigments include phthalocyanine HELIOGEN BLUE L6900™, D6840™, D7080™, D7020™, PYLAM OIL BLUE™, PYLAM OIL YELLOW ™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like. Illustrative examples of yellows are diarylide yellow 3,3-dichlorobenzidine acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan, magenta, yellow components may also be selected a pigments. The colorants, such as pigments, selected can be flushed pigments as indicated herein. Colorant examples further include Pigment Blue 15:3 having a Color Index Constitution Number of 74160, Magenta Pigment Red 81:3 having a Color Index Constitution Number of 45160:3, and Yellow 17 having a Color Index Constitution Number of 21105, and known dyes such as food dyes, yellow, blue, green, red, magenta dyes, and the like.

Additional useful colorants include pigments in water based dispersions such as those commercially available from Sun Chemical, for example SUNSPERSE BHD 6011X (Blue 15 Type), SUNSPERSE BHD 9312X (Pigment Blue 15 74160), SUNSPERSE BHD 6000X Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226) and the like or mixtures thereof. Other useful water based colorant dispersions commercially available from Clariant include HOSTAFINE Yellow GR, HOSTAFINE Black T and Black TS, HOSTAFINE Blue B2G, HOSTAFINE Rubine F6B and magenta dry pigment such as Toner Magenta 6BVP2213 and Toner Magenta E02, which can be dispersed in water and/or surfactant prior to use.

In embodiments, the colorant, for example carbon black, cyan, magenta and/or yellow colorant, may be incorporated in an amount sufficient to impart the desired color to the toner. In general, pigment or dye, may be employed in an amount ranging from about 2% to about 35% by weight of the toner particles on a solids basis, more specifically, from about 5% to about 25% by weight or from about 5% to about 15% by weight. In embodiments, more than one colorant may be present in the toner particles. For example, two colorants may be present in the toner particles, such as a first colorant of pigment blue that may be present in an amount ranging from about 2% to about 10% by weight of the toner particles on a solids basis, more specifically, from about 3% to about 8% by weight or from about 5% to about 10% by weight, with a second colorant of pigment yellow that may be present in an amount ranging from about 5% to about 20% by weight of the toner particles on a solids basis, more specifically from about 6% to about 15% by weight or from about 10% to about 20% by weight.

The toner may also contain a wax. The wax may be present in an amount of from about 5% to about 25% by weight of the particles. Examples of suitable waxes include polypropylenes and polyethylenes commercially available from Allied Chemical and Petrolite Corporation, wax emulsions available from Michaelman Inc. and the Daniels Products Company, EPOLENE N-15™ commercially available from Eastman Chemical Products, Inc., VISCOL 550-P™, a low weight average molecular weight polypropylene available from Sanyo Kasei K.K., and similar materials. The commercially available polyethylenes selected usually possess a molecular weight of from about 1,000 to about 1,500, while the commercially available polypropylenes utilized for the toner compositions of the present invention are believed to have a molecular weight of from about 4,000 to about 5,000. Examples of suitable functionalized waxes include, for example, amines, amides, imides, esters, quaternary amines, carboxylic acids or acrylic polymer emulsion, for example JONCRYL™ 74, 89, 130, 537, and 538, all available from SC Johnson Wax, chlorinated polypropylenes and polyethylenes commercially available from Allied Chemical and Petrolite Corporation and SC Johnson wax.

In embodiments, external additives may be used in the toner. For example, toner particles may be blended with an external additive package using a blender such as a Henschel blender. External additives are additives that associate with the surface of the toner particles. In embodiments, the external additive package may include one or more of silicon dioxide or silica ($SiO_2$), titania or titanium dioxide ($TiO_2$), and cerium oxide. Silica may be a first silica and a second silica. The first silica may have an average primary particle size, measured in diameter, in the range of, for example, from about 5 nm to about 50 nm, such as from about 5 nm to about 25 nm or from about 20 nm to about 40 nm. The second silica may have an average primary particle size, measured in diameter, in the range of, for example, from about 100 nm to about 200 nm, such as from about 100 nm to about 150 nm or from about 125 nm to about 145 nm. The second silica external additive particles have a larger average size (diameter) than the first silica. The titania may have an average primary particle size in the range of, for example, about 5 nm to about 50 nm, such as from about 5 nm to about 20 nm or from about 10 nm to about 50 nm. The cerium oxide may have an average primary particle size in the range of, for example, about 5 nm to about 50 nm, such as from about 5 nm to about 20 nm or from about 10 nm to about 50 nm.

Zinc stearate may also be used as an external additive. Calcium stearate and magnesium stearate may provide similar functions. Zinc stearate may have an average primary particle size in the range of, for example, about 500 nm to about 700 nm, such as from about 500 nm to about 600 nm or from about 550 nm to about 650 nm In embodiments, the developer may be formed by mixing toner particles with one or more carrier particles. Carrier particles that can be selected for mixing with the toner include, for example, those carriers that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Additionally, there can be selected as carrier particles nickel berry carriers as disclosed in U.S. Pat. No. 3,847,604, the entire disclosure of which is hereby incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are hereby incorporated herein by reference. In embodiments, the carrier particles may have an average particle size of from, for example, about 20 to about 85 μm, such as from about 30 to about 60 μm or from about 35 to about 50 μm.

The subject matter disclosed herein will now be further illustrated by way of the following examples. All parts and percentages are by weight unless otherwise indicated.

EXAMPLE 1

Toner Prepared with Anionic Surfactant Prior to Homogenization and Coagulant (Aluminum Sulfate) for Aggregation.

A linear polyester resin emulsion with a glass transition temperature (Tg) of 64.9, an acid number of 21, particle size of 75 nm and pH stabilized at 7 without any surfactants, and with a solids loading of 24%, was obtained from Kao. 118 grams of this emulsion, together with 8.6 g of cyan dispersion (4.5% of toner by weight), 1.2 grams of DOWFAX surfactant solution (47% aqueous), and 250 grams of water was homogenized in a beaker at 5600 rpm, and to this was added dropwise 17.3 grams of a 0.3 N nitric acid solution to a pH of 2.5, followed by 0.15 g of aluminum sulfate in 12 grams of 0.02 nitric acid solution over a 5 minute period. The homogenizer was increased to 9,500 rpm and maintained for an additional 5 minutes, after which the mixture was transferred to a beaker with mechanical stirrer (500 rpm). The mixture was measured to have a pH of 4.3. Aggregates were then grown to about 7.1 microns and then frozen by adding a 4% solution of sodium hydroxide dropwise, until a pH of 8.0 was attained. The mixture displayed a P.S. (particle size) of 7.48 microns (geometric size distribution=1.27/1.29). The mixture was then heated slowly to 80 degrees centigrade with stirring and maintained for about 6 hours, followed by lowering the pH to about 7.2 until the particles coalesced. The toner particles were then washed, filtered and dried. The final particles had an average particle size of 7.11 μm with a circularity of 0.953.

EXAMPLE 2

Toner Prepared without Anionic Surfactant Prior to Homogenization and Addition of Nitric Acid for Aggregation (without Metal Coagulants).

A 2 liter kettle equipped with a heating mantle and mechanical stirrer was chaged with 358 g of the above polyester emulsion EMES 3-25 (Kao Corp.), 750 grams of water, 25.5 g of cyan pigment dispersion (4.5% by weight of toner), and homogenized at 5,600 rpm. 0.3 N nitric acid solution was then added (15 g) until aggregation was achieved, and the mixer increased to 9,000 rpm for 5 minutes, after which 12 grams of TAYCA surfactant was added (17% solution), and shearing continued. The pH of the mixture was 5.1. The mixture was stirred at 330 rpm and then heated to 58° C. over a 1 hour period, during which the particles grew to 8.4 microns, followed by pH adjusting to 8.5 and reducing the stirring speed to 67 rpm. The average particle size was 7.89 microns (GSD=1.25/1.26). The mixture was heated to 78° C. for over 60 minutes and the temperature was maintained for 2 hours, afterwhich the pH was decreased to 6.8 and the temperature was raised to 80° C. for 3 hours to coalesce the particles. The final average particle size was 7.5 microns with a GSD of 1.26/1.25 and a circularity of 0.96.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A process for forming particles, comprising generating an emulsion of a polyester resin having an acid value of from about 16 mg/eq. KOH to about 40 mg/eq. KOH; and generating aggregate particles from the emulsion.

2. The process according to claim 1, further comprising adding a colorant to the emulsion.

3. The process according to claim 1, wherein the generating an emulsion comprises dissolving the polyester resin in an organic solvent, neutralizing the acid groups with an alkali base, and dispersing in water followed by heating to remove the organic solvent, thereby resulting in a latex;

wherein the process further comprises optionally adding to the emulsion a colorant dispersion and/or a wax dispersion;

wherein the generating the aggregate particles comprises shearing and adding an aqueous solution of acid until the pH of the mixture is from about 3 to about 5.5; heating to a temperature of from about 30° C. to about 60° C., wherein the aggregate grows to a size of from about 3 to about 20 microns; raising the pH of the mixture to a range of about 7 to about 9; heating the mixture to about 60° C. to about 95° C.; and optionally decreasing the pH to a range of about 6 to about 6.8.

4. The process according to claim 1, wherein the generating the emulsion comprises omitting any surfactant in the emulsion, and the generating the aggregate particles comprises omitting addition of coagulants.

5. The process according to claim 1, wherein the polyester resin is amorphous, crystalline, semi-crystalline, or a mixture thereof.

6. The process according to claim 1, wherein the polyester resin is a linear amorphous polyester resin.

7. The process according to claim 1, wherein the polyester resin has an acid value from about 25 to about 40 mg/eq KOH.

8. A process for forming particles, comprising forming a latex by generating an emulsion of a polyester resin initially having an acid value of from about 16 mg/eq. KOH to 40 mg/eq. KOH;

optionally adding thereto a colorant dispersion, a wax dispersion, and/or a surfactant;

shearing and adding an aqueous solution of acid until the pH of the mixture is from about 3 to about 5.5, followed by optionally adding an aqueous solution of coagulant;

heating to temperature of from about 30° C. to about 60° C., wherein the aggregate grows to a size of from about 3 to about 20 microns;

raising the pH of the mixture to a range of 7 to about 9;

heating the mixture to about 60° C. to about 95° C.; and optionally decreasing the pH to a range of about 6.0 to about 6.8.

9. The process according to claim 8, wherein the generating the emulsion comprises omitting any surfactant in the emulsion, and the generating the aggregate particles comprises omitting addition of coagulants.

10. The process according to claim 8, further comprising adding the wax dispersion in the amount of from about 5% to about 25% by weight of the toner before or when generating the aggregate composite.

11. The process according to claim 8, further comprising adding the colorant dispersion in the amount of from about 2% to about 35% by weight of the toner before or when generating the aggregate composite.

12. The process according to claim 8, further comprising adding the surfactant in the amount of from about 0.5% to 5% by weight of the toner when generating the aggregate composite.

13. The process according to claim 8, wherein the acid is nitric acid added in the amount of from about 0.01 to about 1 molar until the pH of the mixture is from about 3 to about 5.5.

14. The process according to claim 8, further comprising adding the coagulant, wherein the coagulant is an aluminum sulfate, a polyaluminum chloride, a cationic surfactant, an alkali halide, an alkali acetate, or a water soluble metal salt with valency of about 2 or more, or combinations thereof.

* * * * *